US007718585B2

(12) United States Patent
Levy

(10) Patent No.: US 7,718,585 B2
(45) Date of Patent: May 18, 2010

(54) LUBRICANT COMPOSITIONS AND METHODS

(75) Inventor: Richard Levy, Fort Myers, FL (US)

(73) Assignee: Lee County Mosquito Control District, Fort Myers, FL (US)

( * ) Notice: Subject to any disclaimer, the term of this patent is extended or adjusted under 35 U.S.C. 154(b) by 1321 days.

(21) Appl. No.: 09/357,957

(22) Filed: Jul. 21, 1999

(65) Prior Publication Data

US 2002/0198113 A1 Dec. 26, 2002

Related U.S. Application Data

(63) Continuation of application No. 08/943,125, filed on Oct. 3, 1997, now abandoned, which is a continuation of application No. 08/487,436, filed on Jun. 7, 1995, now abandoned.

(51) Int. Cl.

| | |
|---|---|
| ***C10M 169/04*** | (2006.01) |
| ***C10M 161/00*** | (2006.01) |
| ***C10M 125/00*** | (2006.01) |
| ***C10M 125/04*** | (2006.01) |
| ***C10M 141/06*** | (2006.01) |

(52) U.S. Cl. ..... 508/116; 508/122; 508/123; 508/129; 508/149; 508/150; 508/151; 508/156; 508/158; 508/161; 508/165; 508/166; 508/167; 508/168; 508/169; 508/171; 508/172; 508/459; 508/484; 508/487; 508/488; 508/516

(58) Field of Classification Search ..... 508/116, 508/122, 123, 129, 149–151, 156, 158, 161, 508/165–169, 171–172, 459, 464, 487, 488, 508/516, 484

See application file for complete search history.

(56) References Cited

U.S. PATENT DOCUMENTS

| | | | | |
|---|---|---|---|---|
| 3,244,966 A | | 4/1966 | Li | 508/106 |
| 3,336,225 A | * | 8/1967 | Sayad | |
| 3,873,458 A | | 3/1975 | Parkinson | |
| 3,939,081 A | | 2/1976 | DeHart et al. | 508/150 |
| 3,983,042 A | | 9/1976 | Jain et al. | 508/121 |
| 3,994,697 A | | 11/1976 | Burke | 508/150 |
| 4,050,932 A | | 9/1977 | Lemmer | 508/123 |
| 4,056,103 A | | 11/1977 | Kaczmarzyk et al. | 128/285 |
| 4,076,637 A | | 2/1978 | Hurst | 508/150 |
| 4,096,076 A | | 6/1978 | Spiegleberg | 508/129 |
| 4,104,178 A | | 8/1978 | Jain et al. | 508/121 |
| 4,127,491 A | | 11/1978 | Reich | |
| 4,143,423 A | | 3/1979 | Steinlieb | 508/180 |
| 4,287,073 A | | 9/1981 | Jain et al. | 508/129 |
| 4,340,706 A | * | 7/1982 | Obayashi et al. | 526/207 |
| 4,363,737 A | | 12/1982 | Rodriguez | 508/124 |
| 4,376,710 A | | 3/1983 | Gardos et al. | 508/123 |
| RE31,611 E | | 6/1984 | Wainright | 508/180 |
| 4,474,669 A | | 10/1984 | Lewis et al. | |
| 4,479,981 A | | 10/1984 | Winters et al. | |
| 4,486,319 A | * | 12/1984 | Jamison | |
| 4,525,527 A | | 6/1985 | Takeda et al. | 524/831 |
| 4,541,984 A | | 9/1985 | Palmer | 508/150 |
| 4,552,938 A | | 11/1985 | Mikita et al. | 526/240 |
| 4,557,839 A | | 12/1985 | Tubbs et al. | 508/129 |
| 4,575,430 A | | 3/1986 | Periard et al. | 508/129 |
| 4,612,250 A | | 9/1986 | Takeda et al. | 524/555 |
| 4,616,063 A | * | 10/1986 | Le-Khac | 525/91 |
| 4,618,631 A | | 10/1986 | Takeda et al. | 521/109 |
| 4,647,386 A | | 3/1987 | Jamison | 508/150 |
| 4,654,393 A | | 3/1987 | Mikita et al. | 526/240 |
| 4,677,174 A | | 6/1987 | Alexander et al. | 526/240 |
| 4,703,067 A | | 10/1987 | Mikita et al. | 521/63 |

(Continued)

FOREIGN PATENT DOCUMENTS

| | | |
|---|---|---|
| EP | 0 043 182 | 1/1982 |

(Continued)

OTHER PUBLICATIONS

Shreve, *The Chemical Process Industries*, 2nd Ed. N.Y. pp. 167-168, 1956.*

Booser, Ph.D. *CRC Handbook of Lubrication* (*Theory and Practice of Tribology*) vol. II. Theory and Design, pp. 46-56, 269, 301-315, 33 & 525-530, 1984.*

Windholz, The Merck Index, Windholz, N.J. p. 43 (#4347), 1983.*

Schey, *Tribology In Metalworking* Friction, Lubrication and Wear, pp. 131-179, 431-436, 465-470 and 487-503, 1983.*

*Superabsorbent Polymers*, Science and Technology, ACS Symposium Series 573, Buchholz et al Editor, pp. 27-38 and 88-141, 1994.*

*Absorbent Polymers Technology*, Studies in Polymer Science 8, Lisa Brennon-Peppas et al editors, Elsevier Science Publishers Company Inc. N.Y. pp. 3-55, 126-129, 142-143, 202-205, 223-241, 245, 1990.*

Derwent Abstract J04011697, dated Jan. 16, 1992, p. 01/01.

(Continued)

*Primary Examiner*—Cephia D Toomer

(74) *Attorney, Agent, or Firm*—The Law Offices of Robert J Eichelburg; Robert J Eichelburg

(57) ABSTRACT

A lubricant composition is disclosed comprising a superabsorbent polymer combined with a material for decreasing friction between moving surfaces. The superabsorbent polymer absorbs from about 25 to greater than 100 times its weight in water and may comprise a polymer of acrylic acid, an acrylic ester, acrylonitrile or acrylamide, including copolymers thereof or starch graft co-polymers thereof or mixtures thereof. In the composition, the material for decreasing friction comprises a petroleum lubricant containing an additive, water containing an additive, synthetic lubricant, grease, solid lubricant or metal working lubricant, wherein the synthetic lubricant, grease, solid lubricant or metal working lubricant optionally contain an additive. A method of lubricating a surface is also disclaosed comprising coating said surface with the lubricating composition comprising the superabsorbent polymer combined with a material for decreasing friction between moving surfaces, wherein the material for decreasing friction comprises a petroleum lubricant, water, synthetic lubricant, grease, solid lubricant or metal working lubricant, and optionally an additive.

57 Claims, No Drawings

U.S. PATENT DOCUMENTS

| | | | | | |
|---|---|---|---|---|---|
| 4,740,528 | A | | 4/1988 | Garvey et al. | 521/128 |
| 4,756,841 | A | | 7/1988 | Buran et al. | 508/150 |
| 4,761,241 | A | * | 8/1988 | Kobori et al. | |
| 4,765,917 | A | | 8/1988 | Otaki et al. | 508/121 |
| 4,787,991 | A | | 11/1988 | Morozumi et al. | |
| 4,908,142 | A | | 3/1990 | Dumdum et al. | 508/129 |
| 4,909,951 | A | | 3/1990 | Mendelson et al. | 508/129 |
| 4,965,001 | A | | 10/1990 | King | 508/129 |
| 4,977,192 | A | * | 12/1990 | Martineu et al. | 521/56 |
| 4,983,389 | A | | 1/1991 | Levy | |
| 4,985,251 | A | | 1/1991 | Levy | |
| 4,986,923 | A | | 1/1991 | Waynick | 508/180 |
| 5,013,464 | A | | 5/1991 | Sugimura et al. | 508/150 |
| 5,049,235 | A | | 9/1991 | Barcus et al. | 162/9 |
| 5,049,289 | A | | 9/1991 | Jacobs | 508/129 |
| 5,093,015 | A | | 3/1992 | Oldiges | 508/124 |
| 5,114,886 | A | | 5/1992 | Tsukada | 501/88 |
| 5,156,756 | A | | 10/1992 | Kojima | 508/178 |
| 5,158,694 | A | | 10/1992 | Waynick | 508/150 |
| 5,160,789 | A | | 11/1992 | Barcus et al. | 428/361 |
| 5,173,204 | A | | 12/1992 | Chiddick et al. | 508/180 |
| 5,218,011 | A | * | 6/1993 | Freeman | 523/173 |
| 5,237,945 | A | | 8/1993 | White | 112/420 |
| 5,244,587 | A | | 9/1993 | Ito et al. | 508/180 |
| 5,264,251 | A | | 11/1993 | Geursen et al. | 427/389 |
| 5,268,229 | A | | 12/1993 | Phillips et al. | 428/400 |
| 5,269,953 | A | | 12/1993 | Whewell | 508/129 |
| 5,275,760 | A | * | 1/1994 | Johnson | 252/389.61 |
| 5,298,179 | A | | 3/1994 | Ukita et al. | 44/626 |
| 5,308,514 | A | | 5/1994 | Olson et al. | 508/180 |
| 5,342,686 | A | | 8/1994 | Guersen et al. | 428/378 |
| 5,346,634 | A | | 9/1994 | Sawazaki et al. | 508/129 |
| 5,362,766 | A | * | 11/1994 | Hopkins, Jr. et al. | 523/105 |
| 5,363,821 | A | | 11/1994 | Rao et al. | 508/129 |
| 5,382,287 | A | * | 1/1995 | Podlas | 106/172.1 |
| 5,389,166 | A | | 2/1995 | White | 156/71 |
| 5,397,485 | A | | 3/1995 | Weischel et al. | 508/150 |
| 5,437,802 | A | | 8/1995 | Kurashi et al. | 508/129 |
| 5,442,005 | A | * | 8/1995 | Brugarolas et al. | 524/556 |
| 5,443,899 | A | | 8/1995 | Barcus et al. | 428/288 |
| 5,456,848 | A | | 10/1995 | Nader et al. | 508/180 |
| 5,534,304 | A | * | 7/1996 | Geursen et al. | 427/389.9 |
| 5,592,949 | A | | 1/1997 | Moench et al. | 128/837 |
| 5,611,981 | A | | 3/1997 | Phillips et al. | 264/130 |
| 5,617,877 | A | | 4/1997 | Moench et al. | 128/837 |
| 5,626,154 | A | | 5/1997 | Rogers et al. | 132/200 |
| 5,662,633 | A | | 9/1997 | Doak et al. | 604/378 |
| 5,672,640 | A | | 9/1997 | Brauer | 523/173 |
| 5,675,277 | A | | 10/1997 | Cooper et al. | 210/689 |
| 5,698,074 | A | | 12/1997 | Barcus et al. | 162/9 |
| 5,723,159 | A | | 3/1998 | Phillips et al. | 425/461 |
| 5,728,742 | A | | 3/1998 | Staples et al. | 521/57 |
| 5,733,490 | A | | 3/1998 | Phillips et al. | 264/130 |
| 5,792,717 | A | * | 8/1998 | Takayama | 501/88 |
| 6,319,558 | B1 | | 11/2001 | Willemsen et al. | |

FOREIGN PATENT DOCUMENTS

| | | | | |
|---|---|---|---|---|
| EP | 0 242 040 | | | 10/1987 |
| EP | 0 360 383 | A2 | | 9/1988 |
| EP | 0 317 684 | | | 5/1989 |
| EP | 0 360 383 | A2 | | 3/1990 |
| EP | 0 606 700 | A1 | | 7/1993 |
| EP | 0 536 308 | B1 | | 2/1994 |
| EP | 0 507 875 | B1 | | 6/1995 |
| EP | 0 596 038 | B1 | | 3/1997 |
| EP | 0 779 389 | A2 | | 6/1997 |
| EP | 0 784 116 | A2 | | 7/1997 |
| EP | 0 482 703 | B1 | | 9/1997 |
| EP | 0 630 434 | B1 | | 9/1997 |
| EP | 0 779 389 | A3 | | 3/1998 |
| EP | 0 784 116 | A3 | | 4/1998 |
| EP | 0 651 829 | B1 | | 5/1998 |
| EP | 0 491 453 | B1 | | 7/1998 |
| GB | 2 207 146 | | | 1/1989 |
| GB | 2207146 | A | * | 1/1989 |
| JP | 6-184588 | | | 9/1980 |
| JP | 55-115474 | | | 9/1980 |
| JP | 57-12098 | | | 1/1982 |
| JP | 61-183205 | | | 8/1986 |
| JP | 61-183394 | | | 8/1986 |
| JP | 62-184096 | | | 8/1987 |
| JP | 1-156398 | | | 6/1989 |
| JP | 1-282295 | | | 11/1989 |
| JP | 4-11697 | | | 1/1992 |
| JP | 5-118190 | | | 5/1993 |
| WO | WO 89/12449 | | | 12/1989 |
| WO | 91/09916 | | | 7/1991 |
| WO | WO 93/18223 | | * | 9/1993 |

OTHER PUBLICATIONS

PCT Written Opinion dated Feb. 18, 1997, PCT/US96/10246.
Kirk-Othmer, Encyclopedia of Chemical Technology, Second Ed. vol. 12, pp. 557-609.
PCT Search Report dated Oct. 3, 1996, PCT/US96/10246.
Garner et al. *Journal of Chemical Education*, Jan. 1997, vol. 74 No. 1, p. 95.

* cited by examiner

LUBRICANT COMPOSITIONS AND METHODS

This is a continuation of Ser. No. 08/943,125, filed Oct. 3, 1997 now abandoned, which is a continuation of Ser. No. 08/487,436 filed Jun. 7, 1995 now abandoned, all of which are incorporated herein by reference.

FIELD OF THE INVENTION

The field of the invention is lubricants and especially lubricant compositions comprising a superabsorbent polymer in combination with a lubricant material.

DESCRIPTION OF RELATED ART

Lubricant materials function by separating moving surfaces to minimize friction and wear. Archeological evidence dating to before 1400 B.C. shows the use of tallow to lubricate chariot wheel axles. Leonardo da Vinci discovered the fundamental principles of lubrication and friction, but lubrication did not develop into a refined science until the late 1880's in Britain when Tower produced his studies on railroad car journal bearings in 1885. In 1886 Reynolds developed this into a theoretical basis for fluid film lubrication.

Lubrication principles vary from the separation of moving surfaces by a fluid lubricant through boundary lubrication, to dry sliding. In many respects, these principals are coextensive.

Fluid Film Lubrication

In fluid film lubrication, the load on moving surfaces is supported entirely by the fluid between the surfaces which is a film under pressure. The pressure on the film develops through the motion of the surfaces, which in turn delivers the lubricant into a converging wedge-shaped zone. The behavior of the moving surfaces is totally dependent on the fluidity or viscous behavior of the lubricant. Film pressure and power loss are dependent on the viscosity of the lubricant as well as the configuration of the moving surfaces, and lubricant shear strength. Hydrodynamic or squeeze-film action cannot provide adequate load support in some instances for bearings lubricated with oil or water. Pumping the lubricant into the moving surfaces sometimes provides the necessary hydrodynamic or squeeze-film properties for bearings used for handling heavy loads in low speed equipment. This practice is especially common with low viscosity lubricants such as water. It would therefore be advantageous to provide additives to these types of lubricants to overcome these difficulties.

Oil film lubricants on surfaces are limited in their lubricating capabilities and as such have load limits. Asperities or high spots on the moving surfaces will in turn support the load when the load limit of the lubricant is reached so that the lubrication moves from full-film to mixed-film to complete boundary lubrication with an increase in coefficient of friction between the moving surfaces. High load, low speed, low viscosity lubricants, misalignment, high surface roughness or an inadequate supply of lubricant causes this change from full-film to boundary lubrication. Chemical additives, however, can reduce resultant wear and friction.

Surface contact through asperities on the moving surfaces can result in tearing of the surfaces and is especially a problem with increasing loads. Plastic deformation, temperature buildup and welding of the surfaces with eventual seizure of the surfaces occurs as a result. This problem is especially prevalent in hypoid gears used in automobile differentials. Extreme pressure lubricants combat welding of the surfaces in these circumstances and contain organic compounds that react at these elevated temperatures and form high-melting inorganic lubricant films on the surfaces. Sulfur, chlorine, phosphorous and lead compounds in these additives provide low shear strength layers that minimize surface tearing, or coat the moving surfaces to prevent fusing. Since extreme pressure additives function by chemical action, they are not used where the metal surfaces will be severely eroded. Increasing the lubricant or oil viscosity by means of an additive, lowering the unit bearing loading, improving the finish on the moving surfaces and use of external pressurization offer alternatives to extreme-pressure additives.

Dry rubbing or dry sliding involving solid-to-solid contact occurs in fluid lubrication systems as for example in machine start-up, run-in misalignment or inadequate clearance, reversal of direction of moving surfaces, or any unforeseen or unplanned interruptions in lubricant delivery. Conventional lubricants such as greases or oils also are not used on moving surfaces in extreme temperature, high vacuum, radiation or contamination environments. Dry lubricants applied as thin coatings or as particulate materials in these environments reduce wear and friction of moving surfaces. These films or particulate materials may comprise or incorporate solid or particulate carbon-graphite, lead babbitt, bronze, aluminum, polyethylene or polytetrafluoroethylene solid or particulate materials in a binder where the film or particulates are adhered to one or both of the moving surfaces. The effectiveness of the dry lubricant film or particulates is controlled to some degree by the binder where solid or particulate lubricants are employed as well as conditions of use such as the load, surface temperatures generated during use, speed of the moving surfaces, hardening, fatigue, welding, recrystallization, oxidation and hydrolysis. It would be an advantage therefore to have a binder that was strongly adherent and resistant to some of the conditions generated while in use.

In elastohydrodynamic lubrication carrying the load on rolling contacts in ball and roller bearings, gear teeth, cams or friction drives, minimizes lubrication problems. Focusing the load on a small contact area on these moving surfaces results in high elastic contact stresses. Lubricant films help support the load which is described as "elastohydrodynamic," because of the close relationship between the formation of a thin hydrodynamic fluid lubricant film and elastic deformation.

The lubricant viscosity and film conditions at the entry of the contact zone in these systems generally fix the lubricant film thickness which is substantially uniform over most of its length along the contact. It is believed that high contact pressures lead to excessive lubricant viscosity and pressure distribution close to the Hertz pattern for simple static elastic contact theory. It has also been noted that only a slight reduction in film thickness results with increasing loads with pronounced contact deformation. In plotting contact pressure in psi (pounds per square inch) against distance and direction of lubricant flow, it appears that optimum lubricity is obtained with a sharp pressure spike at the exit portion of the lubricant film; however, this does not take into account changes in temperature, relaxation time or other variables in the lubricating system. It would therefore be an advantage to provide an additive that would enhance viscosity and film formation and retention under these and other conditions.

Load capacity with a full elastohydrodynamic film is limited by fatigue strength of the moving surfaces in rolling contact systems. The working of grain boundaries beneath the contact surface, where shear stress is at a maximum, generates damage. Fatigue cracks occur within this heavily stressed zone with repeated stress cycles. Particles are loosened, which is characterized as surface flaking, and represents the depth of the zone of maximum shear stress. The fatigue cracks are started by focal points of oxide particles and stringers of impurities.

Where the lubricant film thickness becomes less than the surface finish of the moving or rolling surfaces, under high load, low speed or low lubricant viscosity, boundary lubrication comes into play which is dependent upon the chemical nature of the lubricant. The drop in fatigue life can be avoided under such conditions as well as surface wear with the proper lubricant additives.

Petroleum Lubricants

Petroleum based lubricants are extensively used because of their wide availability and consequent low cost. Petroleum lubricants are well known in the art and generally comprise low viscosity and low density paraffins having relatively high freezing points. When combined with oxidation inhibitors to obtain high temperature stability, oxidation resistance is improved and sludging tendency is minimized.

Aromatic petroleum lubricants such as napthenes are generally oxidation stable but form insoluble sludges at high temperatures. Naphthenic oils have low pour point, low oxidation stability and properties between paraffins and aromatics. They are also present in paraffin lubricants to a small degree. Naphthenic oils, however, or naphthenes are used by themselves in combination with oxidation inhibitors. It therefore would be advantageous to provide additives that minimize these difficulties.

Representative petroleum lubricating oils include SAE types 10W, 20W, 30, 40, 50, 10W-30, 20W-40, 75, 80,90 140, 250 and so-called automatic transmission fluids.

Additives

Various additives mixed with lubricating materials help meet the requirements of modern automobile engines, high-speed machinery, high-pressure hydraulic systems, torque converters, aircraft engines, turbine engines, steam engines, steam turbines, electric motors, hydraulic systems and the like.

Petroleum lubricants and other so-called oil-type lubricants employ sulfur, nitrogen or phosphorous type organic compounds, and alkylphenols as antioxidants or oxidation inhibitors. Hydroperoxides initially formed in the oil during oxidation lead to the subsequent production of organic acids and other oxygen containing organic compounds. Antioxidants either inhibit the formation of, or complex, hydroperoxides to minimize the formation of acids, sludge and varnish.

Some commonly employed oxidation inhibitors for steam turbines, electric motors and hydraulic systems include 2-naphthol, di-t-butyl-p-cresol and phenyl-1-naphthylamine. Thiophosphates such as zinc, barium, and calcium thiophosphate are also widely used as antioxidants in lubricating oils for automobile and truck engines.

Alkylsuccinic type acids and other mildly polar organic acids or organic amines are employed as rust inhibitors as well as organic phosphates, polyhydric alcohols, sodium sulfonates and calcium sulfonates.

Many antiwear compounds, generally well known in the art, improve boundary film lubrication, and are classified into seven main groups. The first comprises compounds containing oxygen, such as fatty acids, esters and ketones; the second comprises compounds containing sulfur or combinations of sulfur and oxygen; the third comprises organic chlorine compounds such as chlorinated wax; the fourth includes organic sulfur compounds such as sulphurized fats and sulphurized olefins; the fifth comprises compounds containing both chlorine and sulfur; the sixth, compounds containing organic phosphorous compounds such as tricresyl phosphate, thiophosphates, and phosphites; and the seventh, organic lead compounds such as tetraethyl lead. The use of olefins for lubricating aluminum moving surfaces and iodine for high temperature alloys has also been described in the art.

Antiwear agents employed in boundary lubricants include mildly polar organic acids such as alkylsuccinic type acids and organic amines. Tricresyl phosphate or zinc dialkyldithiophosphate additives are employed in lubricants for hydraulic pumps, gears and torque converters whereas severe rubbing conditions encountered in high load metal-to-metal moving surfaces require lubricants and especially oil type lubricants containing active sulfur, chlorine and lead compounds. These extreme-pressure additives enter into a chemical reaction to form compounds on the surface of the metal moving parts such as lead sulfide, iron chloride or iron sulfide.

Detergents and dispersants are employed in lubricants and function by adsorption on any insoluble particles formed by the moving or sliding contact of two or more surfaces, and maintain the particles in suspension in the lubricant. This minimizes deposits on the moving surfaces and enhances the cleanliness of the moving surfaces. Detergents such as alkyl methacrylate polymers having polar nitrogen groups in the side chain are generally employed and are well known in the art.

The addition of pour-point depressants such as polymethacrylates or wax with naphthalene or wax phenol condensation products also improves the properties of lubricants.

Many lubricants also contain viscosity-index improvers such as polyisobutylenes, polymethacrylates and poly(alkylstyrenes) having a molecular weight of from about 5000 to 20,000. The addition of foam inhibitors such as methyl silicone polymers in lubricating fluids and especially oil type lubricants reduces frothing.

Synthetic Lubricants

Another class of lubricants comprises synthetic oils such as low molecular weight polymerized olefins, ester lubricants, polyglycols and silicones, all of which are widely known in the art. Other synthetic oils include tricresyl phosphate, silicones, other organic phosphates, polyisobutylene, polyphenyl ethers, silicates, chlorinated aromatics, and fluorocarbons.

The silicone lubricants generally comprise low molecular weight polymers or di-organo substituted silicon oxide where the organo groups are ethyl groups, phenyl groups or mixtures thereof and are formulated either as room temperature liquids having the viscosity of oil or compounded into greases. The chlorophenyl methyl silicone oils are especially suitable.

Organic esters generally comprise diesters based on the condensation of long chain diacids having from about 6 to about 10 carbon atoms such as adipic, azelaic or sebacic acid with branched-chain alcohols having from about 8 to about 9 carbon atoms. Higher temperature lubricants employed for turbines and especially jet engines comprise esters of trimethylolpropane or pentaerytheritol with these acids. Polymethacrylates thickening agents, sometimes added in amounts up to about 5%, increase the viscosity of these fluids, which is somewhat lower than petroleum oils.

The polyglycol lubricants comprise those based on polypropylene glycol prepared from propylene oxide and contain terminal hydroxyl groups. These are water insoluble lubricants. Mixtures of propylene and ethylene oxides in the polymerization process will produce a water soluble polymer, also used as a lubricant. Liquid or oil type polyglycols have lower viscosities and molecular weights of about 400, whereas 3,000 molecular weight polyglycols are viscous polymers at room temperature. The use of mono- or polyhydric, such as dihydric, alcohols in the ethylene oxide and/or propylene oxide polymerization results in the formation of mono- or diethers which yield a different class of polyglycols. Esterifying the hydroxyl groups in the polyols with low or high molecular weight acids, i.e., those having up to about 18 carbon atoms gives another variety of polyglycol lubricants.

The polyglycols are employed in various industrial hydraulic fluid applications. They generally do not dissolve rubber and find use as rubber lubricants or as textile fiber lubricants in textile processing. Because they decompose into volatile products at high temperatures they also find use in once-through lubrication systems such as in jet aircraft engines and other high temperature operations that would result in depositing carbonaceous materials on the moving surfaces and consequent operational and maintenance difficulties. Combining water soluble polyglycols with water provides compositions for use in hydraulic applications such as die casting machines, furnace controls, electric welders, and navy hydraulic catapults, as well as equipment handling for missiles.

The phosphate lubricants find use in fire resistance applications and generally comprise triaryl or trialkyl phosphates. Fire resistance applications include die casting machines, aircraft hydraulic fluids, air compressor lubricants and various naval and industrial systems. Blending the phosphates with chlorinated biphenyls provides hydraulic stability.

Polymerization of isobutylene containing smaller amounts of 1-butene and 2-butene provides polybutylene lubricants ranging in viscosity from 5 to over 600 centistokes at 210° F. with a chain length of from about 20 to greater than about 100 carbon atoms. Polyisobutylenes find application in high temperature apparatus such as conveyors, ovens, dryers and furnaces since they decompose and oxidize substantially to entirely volatile by-products leaving no carbon residue contrary to petroleum based lubricants. They find use in electrical transformers, cables, and refrigerator compressors with the higher viscosity grades employed as viscosity-index additives in petroleum lubricants.

Polyphenyl ethers or polyphenoxy polymers, with the ether group in the three phenyl position in the polymer chain find use in high temperature applications such as jet engines and hydraulic systems since they exhibit temperature stability at about 500° F.

Silicate ester high temperature hydraulic fluids generally comprise tetra(2-ethylhexyl) and tetra(2-ethylbutyl) silicates as well as the so-called dimer silicates such as hexa(2-ethylbutoxy) disiloxane.

Chlorinated bi-phenyl fluids provide fire resistance for lubricating fluids and hydraulic fluids.

Fluorocarbons such as polychlorotrifluoroethylene and copolymers of perfluoroethylene perfluoropropylene nonsolid lubricants provide high oxidation resistance in lubricating liquid oxygen and hydrogen peroxide manufacturing and handling equipment.

Greases

Greases comprise high viscosity lubricating fluids, made by combining a petroleum or synthetic lubricating fluid with a thickening agent. The thickeners generally comprise fatty-acid soaps of lithium, calcium, strontium, sodium, aluminum, silica gel, and barium. The grease formulation may also include coated clays such as bentonite and hectorite clays coated with quaternary ammonium compounds. Sometimes carbon black is added as a thickener to improve high-temperature properties of petroleum and synthetic lubricant greases. The addition of organic pigments and powders which include arylurea compounds indanthrene, ureides, and phthalocyanines provide high temperature stability.

Grease additives generally fall into the same category as the additives employed in petroleum lubricants including amine, phenolic, phosphite, sulfur, and selenium oxidation inhibitors. Amine deactivators are also employed where copper staining would be a problem or where copper would tend to promote catalytic oxidation. Amine salts, metal sulfonates, metal napthhenates, esters, and nonionic surfactants provide added water resistance, and some protection against salt-spray corrosion.

Greases employed in gear applications or sliding surface applications contain extreme-pressure additives such as lead soaps, sulfur, chlorine and phosphorous additives as described above. Adding solid powders such as graphite, molybdenum disulfide, asbestos, talc, and zinc oxide provides boundary lubrication.

Glycerol stabilizes the soap structure when used in combination with small amounts of water as well as dimethylsilicone oil to minimize foaming.

Formulating the foregoing synthetic lubricants with thickners provides specialty greases and include, without limitation, polyglycol, diester, silicone-diester, polyester, and silicone lubricants. Nonmelting thickeners are especially preferred such as copper phthalocyanine, arylureas, indanthrene, and organic surfactant coated clays. The organic esters and the silicone greases are generally employed in military applications especially for high temperature use.

The mechanical properties of greases have been measured and those materials having a NLGI number from 0 to 6 characterize these greases.

Solid Lubricants

Solid lubricants include inorganic compounds, organic compounds, and metal in the form of films or particulate materials to provide barrier-layer type of lubrication for sliding surfaces. These materials are substantially solid at room temperature and above, but in some instances will be substantially liquidus above room temperature.

The inorganic compounds include materials such as cobalt chloride, molybdenum disulfide, graphite, tungsten disulfide, mica, boron nitride, silver sulfate, cadmium chloride, cadmium iodide, borax and lead iodide. These compounds exemplify the so-called layer-lattice solids in which strong covalent or ionic forces form bonds between atoms in an individual layer while weaker Van der Waal's forces form bonds between the layers. They generally find use in high temperature applications because of their high melting points, high thermal stabilities in vacuum, low evaporation rates, and good radiation resistance. Especially suitable materials include formulated graphite and molybdenum disulfide. Both molybdenum disulfide and graphite have layer-lattice structures with strong bonding within the lattice and weak bonding between the layers. Sulfur-molybdenum-sulfur lattices form strong bonds whereas weak sulfur-sulfur bonds between the layers allow easy sliding of the layers over one another. Molybdenum disulfide and graphite are therefore especially important solid inorganic lubricants.

The particulate solid materials are formulated as colloidal dispersions in either water, wax, wax emulsions, petroleum oil, castor oil, mineral spirits. The solid non-particulate materials may be employed as solutions in solvents selected to dissolve the solids to form a substantially liquidus composition at room temperature. These solutions in turn can be made into emulsions as described herein, especially water emulsions. Where solvents are unavailable or difficult or expensive to use, the solid lubricants are used as particulates.

The emulsions, as that term is used herein, are either water in oil or oil in water emulsions, or oil in oil emulsions where the solution is either the continuous or discontinuous phase. Water dispersions are used for lubricating dies, tools, metal-working molds, oxygen equipment and in wire drawing.

Graphite-water dispersion used as a lubricant lose water due to evaporation, which is a disadvantage. Mixing the graphite with cadmium oxide or molybdenum disulfide overcomes this.

Other suitable inorganic materials that do not have the layer-lattice structure include basic white lead or lead carbonate, zinc oxide, and lead monoxide.

Dispersing the inorganic compounds in various liquids such as lower molecular weight alcohols, glycols, petroleum oils, synthetic oils, and water, provides compositions used in airframe lubrication, fastenings such as nuts and bolts or screws, gears, wire drawing, and lubricating fittings.

Solid organic lubricant compounds comprise high melting organic powders such as phenanthrene, copper phthalocyanine, and mixtures with inorganic compounds and/or other lubricants. Copper phthalocyanine admixed with molybdenum disulfide comprises a good roller bearing lubricant.

The metal lubricants generally comprise soft metals such as gallium, indium, thallium, lead, tin, gold, silver, copper and the Group VIII noble metals, ruthenium, rhodium, palladium, osmium, iridium, and platinum. Forming these metal lubricants into particulate dispersions in a fluid and especially a liquid such as a liquid lubricant as described herein including petroleum oils, synthetic oils, and water provides easily applied lubricant compositions. Chalcogenides of the non-noble metals may also be employed, especially the oxides, selenides, or sulfides.

Combining the solid lubricants with various binders keeps them in place on the moving surface. Binders are especially necessary in dry lubricant applications employing solid or particulate lubricants, and are sometimes described as bonded solid lubricants. Various thermosetting and thermoplastic and curable binder systems include phenolic, vinyl, acrylic, alkyd, polyurethane, silicone, and epoxy resins. It would be an advantage, however, to provide a novel binder that performed in the same way or improved on the function of these binders.

These types of coatings find application as lubricants for fasteners and bolt assemblies. The solid lubricants employed in the latter application usually include silver, nickel, copper, molybdenum disulfide, lead, or graphite.

Metal Working Lubricants

Metal working is another important area of lubrication metal working which generally comprises operations involving machining, grinding, honing, lapping, stamping, blanking, drawing, spinning, extruding, molding, forging, and rolling. The lubricants employed generally comprise water, mineral oils, fatty oils, and fatty acids, waxes, soaps, various chemical compounds, minerals, and synthetic lubricants as described herein. Some of the foregoing materials will be at a disadvantage because they do not have the proper sticking properties or viscosity properties to remain in place on the metal surfaces during working and accordingly have to be formulated to assure that they will be in place during the metal working operation. The addition of synthetic polymers to these lubricants would overcome some of these disadvantages.

Lubricants are also described by Kirk-Othmer Encyclopedia of Chemical Technology, Second Edition, pp. 559-595 which is incorporated herein by reference.

For the purpose of the present invention, all of the foregoing lubricant compounds or composition will be referred to as materials for decreasing friction between moving surfaces or lubricants.

From the foregoing, it should be apparent that there is a need for additional materials that will provide the same advantages as those of the related art as well as additional advantages and also materials that will overcome some of the various disadvantages of the related art.

Accordingly, the present invention is directed to a novel composition which includes a material for decreasing friction between moving surfaces as well as a method for lubricating a surface.

SUMMARY OF THE INVENTION

These and other advantages are obtained according to the present invention, which is the provision of a composition and a process to enhance the various advantages of the related art and which also substantially obviate one or more of the limitations and disadvantages of the described prior compositions of matter and processes.

The description which follows sets forth additional features and advantages of the invention, apparent not only from the description, but also by practicing the invention. The written description and claims hereof particularly point out the objectives and other advantages of the invention and show how they may be realized and obtained.

To achieve these and other advantages, and in accordance with the purpose of the invention, as embodied and broadly described, the invention comprises a lubricant composition of matter comprising a superabsorbent polymer combined with a material for decreasing friction between moving surfaces or a lubricant as described herein. Where the lubricant is water or a petroleum oil, the composition also includes an additive such as described herein including without limitation, an oxidation inhibitor, a rust inhibitor, antiwear agent, detergent-dispersant, pour-point depressant, viscosity-index improver or foam inhibitor, especially those described herein.

The invention also comprises a method of lubricating a surface comprising coating the surface with a lubricating composition comprising a superabsorbent polymer combined with a material for decreasing friction between moving surfaces as described herein; however, the method of the invention includes the use of water or oil as lubricants as well as other lubricants either with or without-additives as described herein.

The composition, process of producing a product, and product produced thereby of the invention employ inter alia a solid inorganic lubricant as the material for decreasing friction.

Throughout the written description and claims, the lubricant composition is described as a superabsorbent polymer combined with a material for decreasing friction between moving surfaces or lubricant, by which it is intended that the superabsorbent polymer and the lubricant either form a solution, a dispersion, or an emulsion including both water in oil emulsions as well as oil in water emulsions, and oil in oil emulsions wherein a solution is emulsified, and where the solution can be the continuous phase or the discontinuous phase.

The superabsorbent polymer employed according to the invention, absorbs from about 25 to greater than 100 times its weight in water and comprises a polymer of acrylic acid, an acrylic ester, acrylonitrile or acrylamide, including co-polymers thereof or starch graft copolymers thereof, or mixtures thereof, where the mixtures contain from 2 to about 3 or 4 superabsorbent polymers.

Superabsorbent polymers that may be employed in the present invention comprise those generally described and those specifically set forth by Levy in U.S. Pat. Nos. 4,983,389, 4,985,251, and particularly those described in U.S. Pat. No. 4,983,389, in column 9, lines 37-48, column 10, lines 40-68, and column 11, lines 1-21 as well as those also described in U.S. Pat. No. 4,985,251, column 9, lines 1-30. The various U.S. patents to Levy, are incorporated herein by reference for their teachings relative to the superabsorbent polymers.

Other superabsorbent polymers include Aquasorb® which are copolymers of acrylamide and sodium acrylate or the potassium or ammonium salts thereof; Aquasorb® which are acrylamide-sodium polyacrylate cross-linked copolymers; Aquastore™ which is an ionic polyacrylamide, and cross-linked modified polyacrylamides, Terra-Sorb™ which is a hydrolyzed starch-polyacrylonitrile; Sanwet® which is a starch-graft-sodium-polyacrylate, or a polyurethane with starch-graft-sodium polyacrylate, starch-graft-sodium polyacrylate, starch, polymer with 2-propenoic acid, sodium salt, WATER LOCK® which is a poly-2-propenoic acid, sodium salt, and a starch-g poly (2-propenamide-co-2-propenoic acid, sodium salt) or mixed sodium and aluminum salts or potassium or a 2-propenoic acid, sodium salt or polyacrylamide-co-sodium acrylate); Aquakeep® which is a polyacrylic acid, sodium salt, Agri-Gel™ which is an acrylonitrile starch graft copolymer, SGP® 502S which is a starch-g-poly (acrylamide-co-sodium acrylate; Stockosorb® which comprise acrylate/acrylamide copolymers, acrylate/polyvinyl-alcohol copolymers, and polyacrylates, and the various sodium and potassium salts thereof, Favor® C which is a potassium polyacrylate/polyacrylamide copolymer; XU 40346.00 from Dow Chemical which is a partial sodium slat of cross-linked polypropenoic acid; ASAP™ 1000 which is a reaction product of lightly cross-linked sodium polyacrylate in water with hydrophobic amorphous silicon dioxide, and acrylic acid, Aridall™ which are sodium or potassium polyacrylates that may be lightly cross-linked SANWET® which is a starch grafted sodium polyacrylate NORSOCRYL® which is a poly (sodium acrylate) homopolymer, and ALCOSORB™ which is a copolymer of acrylamide and sodium acrylate, and the various superabsorbent polymers described by Takeda et al. U.S. Pat. No. 4,525,527; Mikita et al. U.S. Pat. No. 4,552,938; U.S. Pat. No. 4,618,631; Mikita et al. U.S. Pat. No. 4,654,393; Alexander et al. U.S. Pat. No. 4,677,174; Takeda et al. U.S. Pat. No. 4,612,250; Mikita et al. U.S. Pat. No. 4,703,067; and Brannon-Peppas, *Absorbent Polymer Technology,* 1990. Other superabsorbent polymers may be employed which are further described by Buchholz et al., *Superabsorbent Polymers, Science and Technology,* 1994 ACS. All of the foregoing are incorporated herein by reference.

In one embodiment, the material for decreasing friction comprises a petroleum lubricant containing an additive, water containing an additive, synthetic lubricant, grease, solid lubricant or metal working lubricant, wherein said synthetic lubricant, grease, solid lubricant or metal working lubricant optionally contain an additive. Lubricating oils include either a petroleum oil or synthetic oil or synthetic organic liquid as described herein including without limitations petroleum lubricants including the paraffins, aromatics, naphthenic oils, the synthetic oils, including the silicones, organic esters, polyglycols, phosphates, polyisobutylenes, polyphenol ethers, silicates, chlorinated aromatics, and fluorocarbons all as described herein.

The greases, solid lubricants, and metal working lubricants are also as described herein.

Various mixtures of each of the foregoing lubricants may be used including mixtures of 2 to about 3 or about 4 lubricants.

As noted before, additives described herein are also employed according to the invention. The composition of matter includes additives where petroleum oil or water is used as a lubricant, whereas the method of the invention of lubricating a surface includes the use of superabsorbent polymers in combination with the lubricants described herein, with or without the additives.

The material for decreasing friction between moving surfaces or lubricant employed according to the present invention also includes water or combinations of water and oil whether petroleum oils or synthetic oils as those materials are described herein. When water is used in combination with oil, it generally is employed as an emulsion whether a water in oil emulsion or an oil in water emulsion, both of which are well known in the art and are manufactured by methods that are similarly well known.

The invention also relates to a superabsorbent polymer combined with a solid or particulate inorganic lubricant such as those described herein including mixtures of solid or particulate inorganic lubricants especially mixtures of 2 to about 3 or about 4 solid or particulate inorganic lubricants.

In one embodiment, these inorganic lubricants comprise graphite, the chalcogenides of molybdenum, antimony, niobium, and tungsten, where the chalcogens comprise oxygen, sulfur, selenium, and tellurium and especially molybdenum disulfide, cobalt chloride antimony oxide, niobium selenide, tungsten disulfide, mica, boron nitride, silver sulfate, cadmium chloride, cadmium iodide, borax, basic white lead, lead carbonate, lead iodide, asbestos, talc, zinc oxide, carbon, babbit, bronze, brass, aluminum, gallium, indium, thallium, thorium, copper, silver, gold, mercury, lead, tin, indium, or the Group VIII noble metals.

Chalcogenides of the non-noble metals may also be employed, especially the oxides, selenides or sulfides. In another embodiment, the inorganic solid or particulate material comprises a phosphate such as a zinc phosphate, iron phosphate, or manganese phosphate, or mixtures thereof. Mixtures of the solid or particulate lubricants can be used, especially the 2 component 3 or about 4 component mixtures.

The superabsorbent polymers are also combined with a solid or particulate organic lubricant including mixtures of the organic lubricant and especially 2 to about 3 or about 4 component mixtures.

The solid or particulate organic lubricant comprises phenanthrene, copper phthalocyanine, a fluoroalkylene homopolymer or copolymer such as polytetrafluoroethylene, polyhexafluoroethylene, or copolymers of perfluoroethylene and perfluoropropylene. Homopolymers of polyvinylidene fluoride or copolymers of polyvinylidene fluoride and hexafluoropropylene may also be employed as well as other fluorinated polymers which are well-known in the art. The solid or particulate organic lubricant may also include alkylene homopolymers or copolymers such as polymers of ethylene, propylene, isopropylene, butylene, and isobutylene and the various copolymers thereof especially the 2 or 3 component copolymers thereof. The solid or particulate organic lubricant may also include a paraffinic hydrocarbon wax. Various mixtures of the solid or particulate organic lubricants may also be employed, especially the 2 to about 3 or about 4 component mixtures.

Combinations of the solid or particulate inorganic lubricant and the solid or particulate organic lubricant can also be employed, especially the 2 to about 3 or 4 component combinations. Both the solid or particulate inorganic lubricant and the solid or particulate organic lubricant may also be combined with room temperature liquid materials for decreasing friction between moving surfaces such as oil lubricants and/or synthetic lubricants as described herein or water or combinations of water and oil (including the synthetic lubricants) as described herein.

The solid or particulate inorganic lubricant or solid or particulate organic lubricant can also be used in combination with the superabsorbent polymers either as a mixture of powdered super absorbent polymer with solid or particulate organic lubricant or where the superabsorbent polymer is admixed with water or oil or both as described herein.

The superabsorbent polymer is also combined with a material for decreasing friction which comprises a metal working lubricant containing water or an emulsion of oil and water where the oil is either a petroleum oil or synthetic oil but especially a mineral oil and the emulsion comprises either a water in oil or an oil in water emulsion, the petroleum oils, and synthetic oils having been described herein. The metal working lubricant containing water may also comprise a solid or particulate inorganic or organic lubricant and water where the solid or particulate lubricants are as described herein.

The lubricant compositions of the present invention and the lubricant compositions used according to the method of the invention may comprise room temperature liquid compositions having SAE viscosities as described herein or may have the consistency of grease as that term and those consistencies are described herein.

Throughout the written description and claims, the lubricant is described as a material for decreasing friction between moving surfaces by which it is meant that the material comprises either a compound or composition of matter or mixtures of a compound and a composition of matter.

The average particle size of the particulate inorganic lubricant or organic lubricant or the superabsorbent polymer may be anywhere from about 0.001 in. to about 0.3 in. and especially from about 0.005 in. to about 0.2 in. The superabsorbent polymer (as well as the lubricant composition) may also be in the form of flakes or sheets.

The lubricant composition can be either a liquid, including a viscous liquid, or gel, or a solid, whether rigid, semi-rigid or flexible at room temperature. Solid lubricant compositions also include a powdered lubricant composition. One of the outstanding features of the lubricant composition is that it can be shaped by any conventional molding or extruding process to form discs, sheets, rods, blocks, powders, or filaments, and especially solid lubricant compositions that can be formed to the contours of the surface or surfaces that are being lubricated.

Additionally, multiple dry films of the same or different lubricant composition may also be prepared, i.e. laminar structure lubricants where the layers of the laminate are anywhere from about 2 to about 25 mils thick. These laminates may also have some laminar layers based only on the superabsorbent polymer, or the lubricant, and the balance on the lubricant composition. Additionally, the same or different lubricant composition laminar layers may be used.

The superabsorbent polymer is used in combination with the lubricant in an amount anywhere from about 0.001 wt % to about 99 wt %, and especially from about 0.1 wt % to about 85 wt %, or from about 0.2 wt % to about 75 wt %, based on the combination of lubricant (with or without lubricant additives, or other additives) and superabsorbent polymer. In one experiment, the superabsorbent polymer was combined with about 350 times its weight of powdered graphite. Powders having an average particle size of about 325 mesh are taken up by some of the superabsorbent powders.

The lubricant and additives, when employed, are combined with the superabsorbent polymer by swelling the polymer either by itself or dispersed with the lubricant (and additives when employed), either in water or in a high humidity environment, e.g. 80% R.H.

Prior to, or after exposing the superabsorbent polymer to water or humidity, the polymer, in the form of a powder, flakes or granules is mixed with the lubricant in a conventional mixer, such as a HOBART™ mixer until a uniform dispersion is obtained. This process may be facilitated by employing a solvent or dispersant for the lubricant, preferably in some instances, one that will be easily driven off from the lubricant composition of the invention, such as a ketone, especially the lower alkyl ketones e.g. acetone MEK, MIBK, DIBK, and the like.

The lubricant then combines with, or is taken up by the superabsorbent polymer that has been swollen with water. The lubricant composition is then dried to remove the water, for example by placing it in a 27-38% R.H. environment, or under vacuum or at elevated temperatures. This removes substantially all of the water introduced in the first part of the process.

The lubricant composition, prior to removal of water as described herein, or after removal of water is shaped by molding or extruding, and in the case of forming powdered or granular lubricants, is ground to mesh in a conventional grinding mill after the water has been removed.

Another outstanding feature of the lubricant compositions is their ability, under pressure to release the lubricant as a film or drop, or droplets, such as microdroplets and to recapture the released lubricant after pressure is released or ceases. The superabsorbent polymers of the lubricant compositions in this regard were discovered to have sponge like properties, even though no sponge like characteristics, such as porosity is visible to the naked or unaided eye, when examining the lubricant compositions.

A lubricant composition was made in the foregoing manner employing graphite, as noted above, or a 2 mol ethoxylate of isostearyl alcohol (AROSURF™ 66 E2). Although the latter is used as a surfactant, it also has some lubricating characteristics and is to be considered as a lubricant as well for the purpose of the present invention.

Other solid fillers, adjuvants and diluents can be used in combination with the lubricants employed in the lubricant composition of the present invention, including surfactants, liquid extenders, solvents and the like.

It will be apparent to those skilled in the art that various modifications and variations can be made to the lubricant composition of the present invention comprising a superabsorbent polymer in combination with a material for decreasing friction between moving surfaces as well as the method for lubricating a surface employing such a composition without departing from the spirit or scope of the invention. It is intended that these modifications and variations of this invention are to be included as part of the invention, provided they come within the scope of the appended claims and their equivalents.

The invention claimed is:

1. A lubricating composition of matter comprising a polymer, where said polymer comprises a superabsorbent polymer that absorbs greater than about 100 times its weight in water combined with a material for lubricating a surface wherein said material for lubricating a surface comprises:

(1) a lubricating metal and alloy thereof, a lubricating metal chalcogenide, halide, carbonate, silicate or phosphate, or a particulate lubricating metal nitride, or a carbon lubricant; or (2) a silicate ester, polyphenyl ether, phosphate, biphenyl, phenanthrene, or phthalocyanine compound;

(3) said material for lubricating a surface optionally containing a lubricant comprising an, organic lubricant, inorganic lubricant, or water, or a lubricant additive; or (4) mixtures thereof.

2. A lubricating composition of matter comprising a polymer, where said polymer comprises a superabsorbent polymer that absorbs greater than about 100 times its weight in water combined with a material for lubricating a surface wherein said material for lubricating a surface comprises a solid or particulate inorganic lubricant, containing an organic lubricant, optionally comprising water, or a lubricant additive, or mixtures thereof.

3. The composition of one of claims 1 or 2 wherein said material for lubricating a surface comprises, a carbon, or a metal material that provides barrier-layer lubrication, or mixtures thereof.

4. The composition of one of claims 1 or 2 wherein said material for lubricating a surface comprises graphite, molybdenum disulfide, cobalt chloride, antimony oxide, niobium selenide, tungsten disulfide, boron nitride, silver sulfate, cadmium chloride, cadmium oxide, cadmium iodide, borax, basic white lead, lead carbonate, lead monoxide, lead iodide, asbestos, talc, mica, zinc oxide, zinc phosphate, iron phosphate, manganese phosphate, carbon, babbitt, bronze, brass, aluminum, gallium, indium, thallium, thorium, copper, silver, gold, mercury, lead, tin, or the Group VIII noble metals or mixtures thereof.

5. The composition of one of claims 1 or 2 which includes a material comprising a fluoroalkylene homopolymer or copolymer, a lower alkylene polyolefin homopolymer or copolymer, a paraffinic hydrocarbon wax, phenanthrene, copper phthalocyanine, or mixtures thereof.

6. A lubricating composition of matter comprising a polymer wherein said polymer comprises a superabsorbent polymer that absorbs greater than about 100 times its weight in water combined with a material for lubricating a surface, wherein said material for lubricating a surface comprises water containing a lubricant additive.

7. The lubricating composition of claim 2 wherein said organic lubricant comprises an oil or grease thereof or mixtures thereof and said material for lubricating a surface also comprises water.

8. A lubricating composition of matter of one of claims 1 or 2, wherein said material for lubricating a surface includes water.

9. The composition of claim 8 where said material for lubricating a surface comprises graphite, molybdenum disulfide, cobalt chloride, antimony oxide, niobium selenide, tungsten disulfide, boron nitride, silver sulfate, cadmium chloride, cadmium oxide, cadmium iodide, borax, basic white lead, lead carbonate, lead monoxide, lead iodide, asbestos, talc, mica, zinc oxide, zinc phosphate, iron phosphate, manganese phosphate, carbon, babbit, bronze, brass, aluminum, gallium, indium, thallium, thorium, copper, silver, gold, mercury, lead, tin, the Group VIII noble metals, a fluoroalkylene homopolymer or copolymer, a lower alkylene polyolefin homopolymer or co-polymer, a paraffinic hydrocarbon wax, phenanthrene, copper phthalocyanine, or mixtures thereof.

10. A lubricating composition of matter comprising a polymer wherein said polymer comprises a superabsorbent polymer that absorbs greater than about 100 times its weight in water combined with a material for lubricating a surface, wherein said material for lubricating a surface comprises a phosphate, and wherein said material for lubricating a surface optionally contains a lubricant additive.

11. The composition of claim 10 where said phosphate comprises tricresyl phosphate, zinc phosphate, iron phosphate or manganese phosphate, or mixtures thereof.

12. The composition of one of claims 1 or 2 wherein said organic lubricant comprises a fatty oil, or fatty acid or wax, or mixtures thereof.

13. The composition of claim one of claims 1 or 2 wherein said organic lubricant comprises a synthetic oil lubricant, or greases thereof, or two-mol ethoxylate of isostearyl alcohol, or mixtures thereof.

14. The composition of one of claims 1 or 2 wherein said organic lubricant comprises a soap.

15. The composition of one of claims 1 or 2 wherein said organic lubricant comprises a polymerized olefin.

16. The composition of one of claims 1 or 2 wherein said organic lubricant comprises an organic ester.

17. The composition of one of claims 1 or 2 where said superabsorbent polymer absorbs greater than about 100 times its weight in water and comprises a polymer of acrylic acid, an acrylic ester, acrylonitrile, acrylamide, co-polymers thereof or mixtures thereof, and wherein said lubricant additive comprises an antioxidant, rust inhibitor, antiwear compound, extreme pressure additive, detergent, dispersant, pour point depressant, viscosity-index improver, or foam inhibitor.

18. A lubricating composition of matter comprising a polymer, wherein said polymer comprises a superabsorbent polymer that absorbs greater than about 100 times its weight in water combined with a material for lubricating a surface which comprises a chalcogenide of a non-noble metal or mixtures of chalcogenides of a non-noble metal, optionally containing a lubricant additive.

19. The composition of claim 8 wherein said material for lubricating a surface comprises a chalcogenide of a non-noble metal or mixtures of chalcogenides of a non-noble metal.

20. The composition of claim 18 wherein said material for lubricating a surface comprises a chalcogenide of molybdenum, antimony, niobium, and tungsten and mixtures of said chalcogenides.

21. The composition of claim 8 wherein said material for lubricating a surface comprises a chalcogenide of molybdenum, antimony, niobium, and tungsten and mixtures of said chalcogenides.

22. The composition of claim 18 wherein said material for lubricating a surface comprises a sulfide of molybdenum, antimony, niobium, and tungsten and mixtures of said sulfides.

23. The composition of claim 8 wherein said material for lubricating a surface comprises a sulfide of molybdenum, antimony, niobium, and tungsten and mixtures of said sulfides.

24. The composition of any one of claims 18 or 20 wherein said mixture comprises a two component mixture of said materials for lubricating a surface.

25. The composition of claim 19 wherein said mixture comprises a two component mixture of said materials for lubricating a surface.

26. The composition of any one of claims 18 or 20 wherein said mixture comprises a three component mixture of said materials for lubricating a surface.

27. The composition of claim 19 wherein said mixture comprises a three component mixture of said materials for lubricating a surface.

28. The composition of any one of claims 18 or 20 wherein said mixture comprises a four component mixture of said materials for lubricating a surface.

29. The composition of claim 19 wherein said mixture comprises a four component mixture of said materials for lubricating a surface.

30. A lubricant composition of any one of claims 1 or 2 wherein said organic lubricant comprises a grease or oil, or mixtures thereof.

31. The composition of any one of claims 1, 2, 3, 4 10, 18, or 20 wherein said composition is substantially anhydrous.

32. The composition of claim 3 wherein said composition is substantially anhydrous.

33. The composition of claim 4 wherein said composition is substantially anhydrous.

34. The composition of claim 5 wherein said composition is substantially anhydrous.

35. The composition of claim 10 wherein said composition is substantially anhydrous.

36. The composition of claim 11 wherein said composition is substantially anhydrous.

37. The composition of claim 12 wherein said composition is substantially anhydrous.

38. The composition of claim 13 wherein said composition is substantially anhydrous.

39. The composition of claim 15 wherein said composition is substantially anhydrous.

40. The composition of claim 21 wherein said mixture comprises a two component mixture.

41. The composition of claim 21 wherein said mixture comprises a three component mixture.

42. The composition of claim 21 wherein said mixture comprises a four component mixture.

43. A process of producing a lubricating composition of matter comprising combining a polymer with a material for lubricating a surface;

wherein said polymer comprises a superabsorbent polymer that absorbs greater than about 100 times its weight in water; and wherein said material for lubricating a surface comprises a particulate inorganic lubricant containing an organic lubricant, optionally comprising water, or a lubricant additive;

or mixtures thereof.

44. A product produced by the process of claim 43.

45. A lubricating composition of matter comprising a polymer, where said polymer comprises a superabsorbent polymer that absorbs greater than about 100 times its weight in water combined with a material for lubricating a surface wherein said material for lubricating a surface comprises:

(1) graphite, molybdenum disulfide, cobalt chloride, antimony oxide, niobium selenide, tungsten disulfide, particulate boron nitride, silver sulfate, cadmium chloride, cadmium oxide, cadmium iodide, borax, basic white lead, lead carbonate, lead monoxide, lead iodide, asbestos, talc, mica, zinc oxide, zinc phosphate, iron phosphate, manganese phosphate, carbon, babbit, bronze, brass, aluminum, gallium, indium, thallium, thorium, copper, silver, gold, mercury, lead, tin, the Group VIII noble metals or mixtures thereof; or (2) a silicate ester, polyphenyl ether, phosphate, biphenyl, phenanthrene, or phthalocyanine compound;

(3) said material for lubricating a surface optionally containing a lubricant comprising an, organic lubricant, inorganic lubricant, or water, or a lubricant additive; or (4) mixtures thereof.

46. The composition of claim 45 which includes a material comprising a fluoroalkylene homopolymer or copolymer, a lower alkylene polyolefin homopolymer or co-polymer, a paraffinic hydrocarbon wax, phenanthrene, copper phthalocyanine, or mixtures thereof.

47. A lubricating composition of matter of one of claim 45 or 46, wherein said material for lubricating a surface includes water.

48. The composition of one of claims 45 or 46 wherein said organic lubricant comprises a fatty oil, or fatty acid or wax, or mixtures thereof.

49. The composition of claim one of claims 45 or 46 wherein said organic lubricant comprises a synthetic oil lubricant, or greases thereof, or two-mol ethoxylate of isostearyl alcohol, or mixtures thereof.

50. The composition of one of claims 45 or 46 wherein said organic lubricant comprises a soap.

51. The composition of one of claims 45 or 46 wherein said organic lubricant comprises a polymerized olefin.

52. The composition of one of claims 45 or 46 wherein said organic lubricant comprises an organic ester.

53. The composition of one of claims 45 or 46 where said superabsorbent polymer absorbs greater than about 100 times its weight in water and comprises a polymer of acrylic acid, an acrylic ester, acrylonitrile, acrylamide, co-polymers thereof or mixtures thereof, and wherein said lubricant additive comprises an antioxidant, rust inhibitor, antiwear compound, extreme pressure additive, detergent, dispersant, pour point depressant, viscosity-index improver, or foam inhibitor.

54. A lubricant composition of any one of claims 45 or 46 wherein said organic lubricant comprises a grease, or oil, or mixtures thereof.

55. The composition of any one of claim 45 or 46 wherein said composition is substantially anhydrous.

56. A process of producing a lubricating composition of matter comprising combining a polymer with a material for lubricating a surface;

wherein said polymer comprises a superabsorbent polymer that absorbs greater than about 100 times its weight in water; and wherein said material for lubricating a surface comprises:

(1) graphite, molybdenum disulfide, cobalt chloride, antimony oxide, niobium selenide, tungsten disulfide, particulate boron nitride, silver sulfate, cadmium chloride, cadmium oxide, cadmium iodide, borax, basic white lead, lead carbonate, lead monoxide, lead iodide, asbestos, talc, mica, zinc oxide, zinc phosphate, iron phosphate, manganese phosphate, carbon, babbit, bronze, brass, aluminum, gallium, indium, thallium, thorium, copper, silver, gold, mercury, lead, tin, the Group VIII noble metals or mixtures thereof; or (2) a silicate ester, polyphenyl ether, phosphate, biphenyl, phenanthrene, or phthalocyanine compound;

(3) said material for lubricating a surface optionally containing a lubricant comprising an, organic lubricant, inorganic lubricant, or water, or a lubricant additive; or (4) mixtures thereof.

57. A product produced by the process of claim 56.

* * * * *